US006782823B1

(12) United States Patent
Jentzsch

(10) Patent No.: US 6,782,823 B1
(45) Date of Patent: Aug. 31, 2004

(54) IMAGING UNIT FOR A PRINTING FORM CYLINDER

(75) Inventor: Arndt Jentzsch, Coswig (DE)

(73) Assignee: Koenig & Bauer, AG, Würzburg (DE)

( * ) Notice: Subject to any disclaimer, the term of this patent is extended or adjusted under 35 U.S.C. 154(b) by 0 days.

(21) Appl. No.: 09/924,157

(22) Filed: Aug. 7, 2001

(30) Foreign Application Priority Data

Aug. 9, 2000 (DE) ..... 100 39 817

(51) Int. Cl.[7] ..... B41C 1/04
(52) U.S. Cl. ..... 101/466; 101/478
(58) Field of Search ..... 101/463.1, 465, 101/466, 467, 478, 401.1, 425

(56) References Cited

U.S. PATENT DOCUMENTS

| | | | | | |
|---|---|---|---|---|---|
| 4,718,340 | A | * | 1/1988 | Love, III | 101/116 |
| 5,129,321 | A | * | 7/1992 | Fadner | 101/467 |
| 5,148,746 | A | * | 9/1992 | Fuller et al. | 101/142 |
| 5,713,287 | A | * | 2/1998 | Gelbart | 101/467 |
| 5,996,499 | A | * | 12/1999 | Gelbart et al. | 101/467 |
| 6,180,325 | B1 | * | 1/2001 | Gelbart | 430/397 |
| 2002/0053295 | A1 | * | 5/2002 | Jentzsch | 101/217 |
| 2003/0005834 | A1 | * | 1/2003 | Jentzsch | 101/211 |

FOREIGN PATENT DOCUMENTS

| | | |
|---|---|---|
| DE | 19508843 | 9/1996 |
| DE | 19812927 | 11/1996 |
| EP | 965444 | * 12/1999 |
| EP | 1090760 | 4/2001 |

* cited by examiner

*Primary Examiner*—Stephen R. Funk
(74) *Attorney, Agent, or Firm*—Goodwin Procter LLP

(57) ABSTRACT

An imaging unit for a printing form cylinder of a printing press, the printing form cylinder having a width, the imaging unit comprising: an imaging unit comprising, in combination: a cleaning unit, a coating unit positioned below said cleaning unit, an image creating unit positioned below said coating unit, and an image developing unit positioned below said image creating unit. Each of the cleaning, coating, image creating and image developing units traverse over the width of the printing form cylinder thereby rendering reverse movement without active operation to the other side of the printing form cylinder unnecessary.

6 Claims, 1 Drawing Sheet

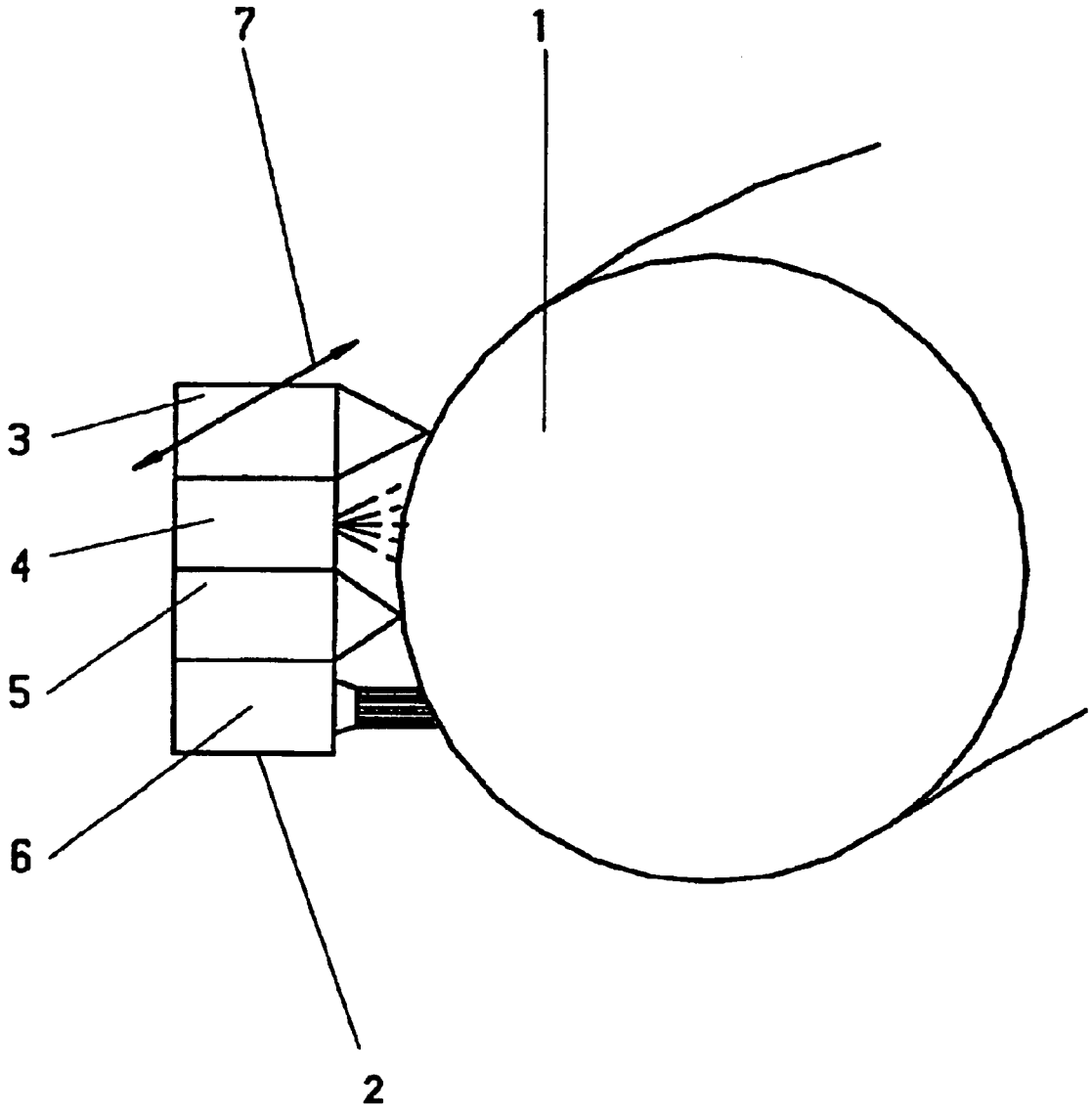
7
1
3
4
5
6
2

IMAGING UNIT FOR A PRINTING FORM CYLINDER

FIELD OF INVENTION

The invention relates to an imaging unit in a printing press.

BACKGROUND OF INVENTION

A printing press with a printing unit having a seamless image cylinder, which is coated with a dryable polymer by a direct image creation process in the printing unit is known from German patent NO. 19612927 Al.

The surface characteristic of the dryable polymer on the image cylinder is completely converted or only in certain areas by a selective laser exposure after drying to change its affinity to a printing ink. In a conventional printing press either in wet offset printing or in dry-offset printing the image cylinder is used instead of the plate cylinder. The image cylinder is cleaned of the image carrying layer after the printing. This layer must not be totally removed.

The laser source, the coating unit and the drying unit are mounted side by side on a spindle drive. They are moved according to the rotation of the spindle over the width of the cylindrical imaging surface. The cleaning unit is separately allocated.

The lacking of complexity of the apparatus and necessary unproductive time during reversing of the spindle drive represent disadvantage.

SUMMARY DESCRIPTION OF INVENTION

It is an object of the inventions to provide a compact imaging unit with a short operating time.

That object is solved according to the present invention by allocating the coating unit, the image creation unit and the developing unit together one below the other in a traversing imaging unit.

BRIEF DESCRIPTION OF THE DRAWING

The invention is described below in greater detail by an embodiment thereof and by reference to the drawing wherein the sole FIG. 1 shows the imaging unit.

DETAILED DESCRIPTION

FIG. 1 shows a printing form cylinder 1 with an imaging unit 2. The imaging unit 2 contains a cleaning unit 3, preferably using laser but possibly also working with an abrasive, a coating unit 4 located below the cleaning unit 3, an image creating unit 5 located below the coating unit 4, and a developing unit 6 located below the image creating unit 5.

The operation of the four aforementioned units is known and is therefore described only briefly. The image layer of the preceding printing job is removed from the printing form cylinder 1 by the cleaning unit 3. The coating unit 4 applies a new layer for taking the image to the printing form cylinder l by spraying or splashing. The image creating unit 5 is creating the image on this applied layer and with it creating the printing form for the new printing job.

The coating unit 4 and the image creation unit 5 are combined in a combination unit, which operates in this case on the ink jet principle.

The image creating unit 5 re-works the image carrying layer for instance by hardening and/or cleansing, etc.

The image unit 2 is mounted on a spindle carriage (not shown) and traverses over the width of the printing form cylinder 1 in the direction of the arrow.

The combine allocation of the cleaning unit 3, the coating unit 4, the image creating unit 5 and the developing unit 6 in the imaging unit 2 permits an overlapping of the operating times of the different units. No reverse movement without active operation to the other side of the printing form cylinder is necessary.

What is claimed is:

1. An imaging unit for a printing form cylinder of a printing press, said printing form cylinder having a width, said imaging unit comprising:

an imaging unit comprising, in combination:

a cleaning unit, a coating unit positioned below said cleaning unit, an image creating unit positioned below said coating unit, an image developing unit positioned below said image creating unit; and wherein each of said cleaning, coating, image creating and image developing units traverse over the width of said printing form cylinder.

2. The imaging unit of claim 1, wherein said cleaning unit comprises a laser.

3. The imaging unit of claim 1, wherein said cleaning unit comprises an abrasive medium.

4. An imaging unit for a printing form cylinder of a printing press, said printing form cylinder having a width, said imaging unit comprising:

an imaging unit comprising, in combination:

a cleaning unit, a combined coating and image creating unit positioned below said cleaning unit, an image developing unit positioned below said image creating unit; and wherein each of said cleaning, coating and image creating, and image developing units traverse the width of said printing form cylinder.

5. The imaging unit of claim 4, wherein said cleaning unit comprises a laser.

6. The imaging unit of claim 4, wherein said cleaning unit comprises an abrasive medium.

* * * * *